US006618059B1

(12) United States Patent
Furuta

(10) Patent No.: US 6,618,059 B1
(45) Date of Patent: Sep. 9, 2003

(54) DIVER'S INFORMATION DISPLAY DEVICE

(75) Inventor: Naoshi Furuta, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/486,656

(22) PCT Filed: Jun. 10, 1999

(86) PCT No.: PCT/JP99/03287

§ 371 (c)(1),
(2), (4) Date: Jun. 28, 2000

(87) PCT Pub. No.: WO00/00385

PCT Pub. Date: Jan. 6, 2000

(30) Foreign Application Priority Data

Jun. 26, 1998 (JP) ..... 10-181178

(51) Int. Cl.[7] ..... G09G 5/00
(52) U.S. Cl. ..... 345/772; 345/710
(58) Field of Search ..... 345/772, 773, 345/710, 705–709, 711–715, 741–743, 745–747, 853–855; 702/139, 131, 79

(56) References Cited

U.S. PATENT DOCUMENTS

| | | | | |
|---|---|---|---|---|
| 4,533,256 A | | 8/1985 | Ostendorf | |
| 4,882,678 A | | 11/1989 | Hollis et al. | |
| 5,570,323 A | * | 10/1996 | Prichard et al. | 367/118 |
| 5,570,688 A | * | 11/1996 | Cochran et al. | 128/205.23 |
| 5,907,281 A | * | 5/1999 | Miller, Jr. et al. | 340/573.6 |
| 6,084,881 A | * | 7/2000 | Fosmark et al. | 370/397 |
| 6,219,042 B1 | * | 4/2001 | Anderson et al. | 345/747 |
| 6,272,073 B1 | * | 8/2001 | Doucette et al. | 367/131 |
| 6,360,182 B1 | * | 3/2002 | Hales | 702/139 |

FOREIGN PATENT DOCUMENTS

| | | | |
|---|---|---|---|
| EP | 0 805 105 A2 | 11/1997 | |
| GB | 2 283 333 | 5/1995 | |
| JP | 62-71890 | 4/1987 | G01C/13/00 |
| JP | 2-179594 | 7/1990 | B63C/11/02 |
| JP | 7-225287 | 8/1995 | G04G/1/00 |
| JP | 8-211168 | 8/1996 | G04G/1/00 |
| JP | 11-23745 | 1/1999 | G04G/1/00 |
| JP | 11-23746 | 1/1999 | G04G/1/00 |
| JP | 11-23747 | 1/1999 | G04G/1/00 |

OTHER PUBLICATIONS

"*Decompression–Decompression Sickness*" Springer, Berlin, 1984, pp. 1–86.

"*Dive Computers: A Consumer's Guide To History, Theory, and Performance*" (Watersport Publishing Inc., 1994), Ken Loyst, et al., pp 1–171.

* cited by examiner

*Primary Examiner*—Steven Sax
(74) *Attorney, Agent, or Firm*—Mark P. Watson

(57) ABSTRACT

In a divers' information display device, a plurality of display modes or the manner of switching features has been improved in order to thus improve the display ability of the device. The divers' information display device has simplified switching of indications and is user-friendly. Specifically, a time mode 201 is changed to a log mode 203 by performing a manipulation, and to a plan and surface mode 202 by performing another manipulation. In the plan and surface mode 202, an amount of intracorporeal nitrogen, a nitrogen discharge completion time, a depth-of-water rank, and a non-decompression diving enabled time are indicated. After plunging into water is acknowledged, any of the time mode 201, plan and surface mode 202, and log mode 203 is automatically changed to a dive mode 204. After the dive mode 204 is designated, if a diver ascends, the dive mode is automatically changed to the plan and surface mode 202. Even when a diver ascends, the diver need not manipulate any external manipulation member but can plan a diving schedule immediately.

21 Claims, 7 Drawing Sheets

DIVER'S INFORMATION DISPLAY DEVICE

BACKGROUND OF THE INVENTION

Technical Field

The present invention relates to a divers' information display device. More particularly, this invention is concerned with a technology preferable for a display device which is an integral part of an information processing apparatus and on which a time instant indication and various diving-related indications are mutually changed and selectively displayed.

BACKGROUND ART

Wristwatches having an added ability relevant to diving and intended for divers have been locally available in the past. This sort of wristwatch may have an information processing unit incorporated therein. The information processing unit is formed with a microprocessor (MPU) for determining a diving situation, estimating the physical condition of a wearer, and instructing the wearer then diving. The wristwatch may be referred to as a dive computer or divers' computer.

Some divers' information processing apparatuses referred to as the dive computers perform arithmetic operations to calculate the conditions for decompression performed during diving. The calculating procedure is described in, for example, "Dive Computers: A consumer's Guide to History, Theory, and Performance" (Watersport Publishing Inc., 1991) written by Ken Loyst et al. Writings concerning the theory of decompression include "Decompression: Decompression Sickness" (Springer, Berlin, 1984). Either writing implies that an inert gas (nitrogen) permeating a living body during diving causes decompression sickness. From the viewpoint of minimizing the occurrence of decompression, the latter writing has proposed on page 14 thereof a calculating procedure based on a formula (1) below.

$$\mathrm{Pigt}(t_E)=\mathrm{Pigt}(t_0)+\{\mathrm{PIig}-\mathrm{Pigt}(t_0)\}\times\{1-\exp[-kt_E]\} \quad (1)$$

where $\mathrm{Pigt}(t_E)$ denotes the partial pressure of an intracorporeal inert gas in a time interval $t_E$, $\mathrm{Pigt}(t_0)$ denotes the partial pressure of the intracorporeal inert gas in a time interval $t_0$, PIig denotes the partial pressure of an inert gas in breath, and k denotes an experimentally determined constant.

The formula (1) is concerned with intake and discharge of an inert gas into and from a diver's body. According to the formula (1), when the partial pressure of the intracorporeal inert gas, Pigt(t), is smaller than the partial pressure PIig, the inert gas is taken into the diver's body and the partial pressure of the intracorporeal inert gas increases. When the partial pressure of the intracorporeal inert gas, Pigt(t), is larger than the partial pressure PIig, the inert gas is discharged from the diver's body and the partial pressure of the intracorporeal inert gas therefore decreases.

When the partial pressure of the intracorporeal inert gas becomes equal to or larger than a certain pressure, a diver must ascend (decompress) slowly so as to minimize the occurrence of diver's paralysis. At this time, the diver must manage an ascending speed or an ascending time until he/she rises to the surface of the water. Therefore, many information processing devices having the ability to estimate the partial pressure of a wearer's intracorporeal inert gas and the ability to manage ascending so as to minimize the occurrence of diver's paralysis have been proposed as the dive computer.

A facility for indicating an alarm so as to minimize the occurrence of diver's paralysis and a facility for estimating the partial pressure of an wearer's intracorporeal insert gas and indicating the partial pressure as physical information must be implemented without failure to avoid the dangers of diving. With a dive computer to be worn on a diver's body, for example, a wristwatch-like dive computer, the area assigned to the display is limited. There is, therefore, difficulty in displaying all information at one time without impairment of discernment. For this reason, many conventional dive computers are designed to switch between a time mode, a plan mode, a surface mode, a log mode, and a dive mode depending on a situation or through manipulation performed by a wearer. In the time mode, a current year/month/day indication and a current time instant indication are displayed. In the plan mode, future diving is scheduled. In the surface mode, the partial pressure of an inert gases accumulated in a diver's body due to past dives is indicated. In the log mode, the results of past dives are reproduced. In the dive mode, the physical condition such as the partial pressure of an intracorporeal inert gas is indicated during diving.

FIG. 8(*a*) and FIG. 8(*b*) illustratively show switching of modes of display permitted by a conventional wristwatch-like dive computer. In an example shown in FIG. 8(*a*), an external manipulation member is manipulated repeatedly in order to successively switch between the plan mode, surface mode, and log mode. Moreover, indications are switched merely between the surface mode and dive mode. In an example shown in FIG. 8(*b*), the surface mode, plan mode, and log mode are switched between one another. Similarly to the example shown in FIG. 8(*a*), indications are switched merely between the surface mode and dive mode. As indicated with a dotted line in the drawings, the time mode is normally unified with the surface mode or automatically switched to the surface mode or vice versa. For example, when the partial pressure of an intracorporeal inert gas is normal, the time mode is set automatically. When the partial pressure of an intracorporeal inert gas is higher than a normal pressure because of past dives, the surface mode is set automatically.

In the conventional dive computer, after diving is started, if ascending and diving are repeated, the dive computer also repeats the transition between the dive mode and the surface mode. When a diver ascends during diving, the diver may want to plan a subsequent diving schedule. In general, the partial pressure of an intracorporeal inert gas and the time required until the partial pressure of the intracorporeal inert gas returns to an equilibrium value are often indicated in the surface mode. In addition, a current time instant and a calendar may be indicated. However, a facility for indicating a diving depth (or a depth-of-water rank to be described later) and a diving enabled time (or a non-decompression diving enabled time to be described later) that are indicated in the plan mode is invalid in the surface mode. For planning s subsequent diving schedule on the surface of the water, the external manipulation member must be manipulated in order to change the surface mode to the plan mode temporarily. After planning is completed, the surface mode must be restored before diving is restarted.

Moreover, for making the most of the. foregoing dive computer offering numerous modes and having numerous facility, the contents of the display modes and facilities must be fully understood. Moreover, the complex way of manipulating the external manipulation member must be learned in order to utilize the display modes and facilities. The way of manipulation becomes complex as the facilities become complex. This poses a problem in that a user must incur a large load. In particular, when it is necessary to change a plurality of display modes as shown in FIG. 8, the small external manipulation member of the small wristwatch-like body must be manipulated many times. If a user forgets the manner of manipulation even partly, the user cannot make the most of the facilities of the dive computer.

OBJECTS OF THE INVENTION

The present invention attempts to solve the foregoing problems. An object of the present invention is to provide a divers' information display device for a dive computer or the like. Herein, the present invention is intended to improve the manner of switching between a plurality of display modes or a plurality of facilities so as to thus improve the display feature of the display device, and to provide a configuration permitting easy switching of indications. More particularly, the present invention is intended to realize a technology for improving maneuverability sensed after the start of diving and upgrading the display feature.

DISCLOSURE OF THE INVENTION

For solving the above problems, the first feature in accordance with the present invention is implemented in a divers' information display device having the ability to display a diving situation indication, a physical indication, and a diving schedule indication. Herein, the diving situation indication indicates a wearer's diving situation. The physical indication indicates a physical state change that is attributable to wearer's diving and calculated based on the diving situation. The diving schedule indication provides information assisting a wearer in planning a preferable diving schedule. In the divers' information display device, a plan and surface mode in which the physical indication and diving schedule indication are displayed primarily, and a dive mode in which the diving situation indication is displayed primarily are implemented. When diving is started in the plan and surface mode, the plan and surface mode is automatically changed to the dive mode. When diving is terminated or suspended, the dive mode is automatically changed to the plan and surface mode.

According to the above feature, the plan and surface mode in which the physical indication and diving schedule indication are displayed is implemented. Even when a diver ascends during diving, the diver can grasp his/her physical condition and plan a diving schedule according to the physical condition without the necessity of switching display modes. Moreover, switching of indications between the plan and surface mode and the dive mode is automatically achieved at the start or end of diving or with suspension of diving. This almost completely obviates the necessity of performing manipulations during diving.

According to an aspect of the invention a time mode in which a time instant indication is displayed primarily is implemented. Preferably, when diving is started in the time mode, the time mode is automatically changed to the dive mode. Since the time mode is implemented, the diver's information display device normally functions as a clock. Moreover, since the time mode is automatically changed to the dive mode, a diver can enjoy diving safely without making any preparations.

According to another aspect, a dive history memory is included for storing a history of wearer's past dives. A log mode is implemented in order to retrieve and display the dive history. Preferably, when diving is started in the log mode, the log mode is automatically changed to the dive mode.

According to another aspect, first and second external manipulation members are included. Preferably, when the first external manipulation member is manipulated in any of the three modes of the time mode, plan and surface mode, and log mode, any of two display modes is changed to a first display mode. When the second external manipulation member is manipulated, any of two display modes is changed to a second display mode. Any of the three display modes can be changed to either of the other two display modes. One of the two external manipulation members need only be manipulated in order to change the display modes. This leads to improved maneuverability.

A The second feature in accordance with the present invention is implemented in a divers' information display device having the ability to display a time instant indication, a diving situation indication, a physical indication, and a diving schedule indication. The diving situation indication indicates a wearer's diving situation. The physical indication indicates a physical state change that is attributable to wearer's diving and is calculated based on the diving situation. The diving schedule indication provides information assisting a wearer in planning a diving schedule according to the physical indication. The divers' information display device includes a dive history memory for storing a history of wearer's past dives, and first and second external manipulation members. A time mode, a plan and surface mode, a dive mode, and a log mode are implemented in the divers' information display device. In the time mode, the time instant indication is primarily displayed. In the plan and surface mode, the physical indication and diving schedule indication are primarily displayed. In the dive mode, the diving situation indication is mainly displayed. In the log mode, the dive history is retrieved and displayed. When the first external manipulation member is manipulated in any of the three modes of the time mode, plan and surface mode, and log mode, either of two display modes is changed to a first display mode. When the second external manipulation member is manipulated, either of two display modes is changed to a second display mode.

According to another aspect, when the first external manipulation member is manipulated in the time mode, the time mode is changed to the plan and surface mode. Preferably, when the second external manipulation member is manipulated therein, the time mode is changed to the log mode. When the first external manipulation member is manipulated in the plan and surface mode or when the second external manipulation member is manipulated in the log mode, the time mode is restored. Among the three display modes, changing from the time mode to the plan and surface mode and restoring the time mode are achieved using the first external manipulation member all the time. Changing from the time mode to the log mode and restoring the time mode are achieved using the second external manipulation member all the time. Consequently, it is easy to learn the manner of manipulation and to store and preserve data. This leads to the easy-to-use divers' information display device. p According to another aspect, preferably, when the second external manipulation member is manipulated in the plan and surface mode, the plan and surface mode is changed to the log mode. When the first external manipulation member is manipulated in the log mode, the log mode is changed to the plan and surface mode.

According to another aspect, preferably, when the first external manipulation member is manipulated in the time mode, the time mode is changed to the plan and surface mode. When the second external manipulation member is manipulated therein, the time mode is changed to the log mode. When the second external manipulation member is manipulated in the plan and surface mode, the plan and surface mode is changed to the log mode. When the first external manipulation member is manipulated in the log mode, the log mode is changed to the plan and surface mode. When the first external manipulation member is manipulated in any of the three display modes, the display mode is changed to the plan and surface mode. When the second external manipulation member is manipulated in any of the three display modes, the display mode is changed to the log mode. Consequently, the external manipulation member associated with a display mode to be selected need only be manipulated. It is therefore easy to learn the manner of manipulation and to store and preserve data. This leads to the easy-to-use divers' information display device.

According to the foregoing feature, the practical examples of the diving situation indication include an indication of information relevant to a current dive or past and current dives. The information is classified into such items as a depth of water, a diving time (elapsed time since the start of diving), a maximum depth of water, and a water temperature. Moreover, the practical examples of the physical indication include an indication of information relevant to a physical condition dependent on diving. The information is classified into such items as the partial pressure of an intracorporeal inert gas, an intracorporeal inert gas discharge completion time (an estimated time required until the partial pressure of the intracorporeal inert gas reaches an equilibrium value), and an intracorporeal inert gas discharge time (time interval during which the intracorporeal inert gas is discharged, that is, a surface-of-water pause time). Furthermore, the practical examples of the diving schedule indication include an indication of information serving as an index for planning a future diving schedule according to the physical indication. The information is classified into such items as a depth of water to which a diver dives, and a non-decompression diving enabled time (time during which diving is enabled without the necessity of undergoing decompression during ascending). Moreover, the physical indication includes an indication relevant to an intracorporeal inert gas which is obtained through calculation according to a formula (for example, a formula 3 to be described later) devised based on experiments. According to the aforesaid feature, the plan and surface mode is automatically changed to the dive mode or vice versa at the time of the start, end, and suspension of diving. The start, end, or suspension of diving may be judged simply from whether a diver has plunged into water and withdrawn therefrom as it is in an embodiment described later. Otherwise, the start, end, or suspension of diving may be judged from whether a depth of water is larger or smaller than a predetermined depth of water. Moreover, the display modes may be changed in a predetermined time after the conditions for mode change are met.

According to the aforesaid feature, no external manipulation member may be manipulated for a predetermined time in the plan and surface mode or in the log mode among the three display modes of the time mode, plan and surface mode, and log mode. In this case, if an amount of intracorporeal inert gas is larger than that in a normal state, the plan and surface mode is maintained or the log mode is changed to the plan and surface mode. If the amount of intracorporeal inert gas assumes an equilibrium value, the plan and surface mode or log mode is changed to the time mode.

Aside from the aforesaid feature, another feature to be described in this description is implemented in an information display device offering a time mode in which a time instant is indicated. The information display device also offers a time difference correction mode in which a time difference derived from a wearer's movement is corrected. The time difference correction mode enables correction of a time instant indication in units of a time suitable for correction of a time difference. The unit time is, for example, one hour, thirty minutes, or fifteen minutes. According to the feature, a manipulation to be performed for correcting a time difference can be simplified. Moreover, it prevents the time difference from being corrected in units of an improper time shorter than the unit time (for example, in N seconds) by mistake. This feature is preferably adapted to a divers' information display device or a divers' information processing apparatus. Preferably, this feature is combined with any of the aforesaid feature.

BRIEF DESCRIPTION OF THE DRAWINGS

In the drawings, wherein like reference symbols refer to like parts.

BEST MODE FOR CARRYING OUT THE INVENTION

Figure 1:
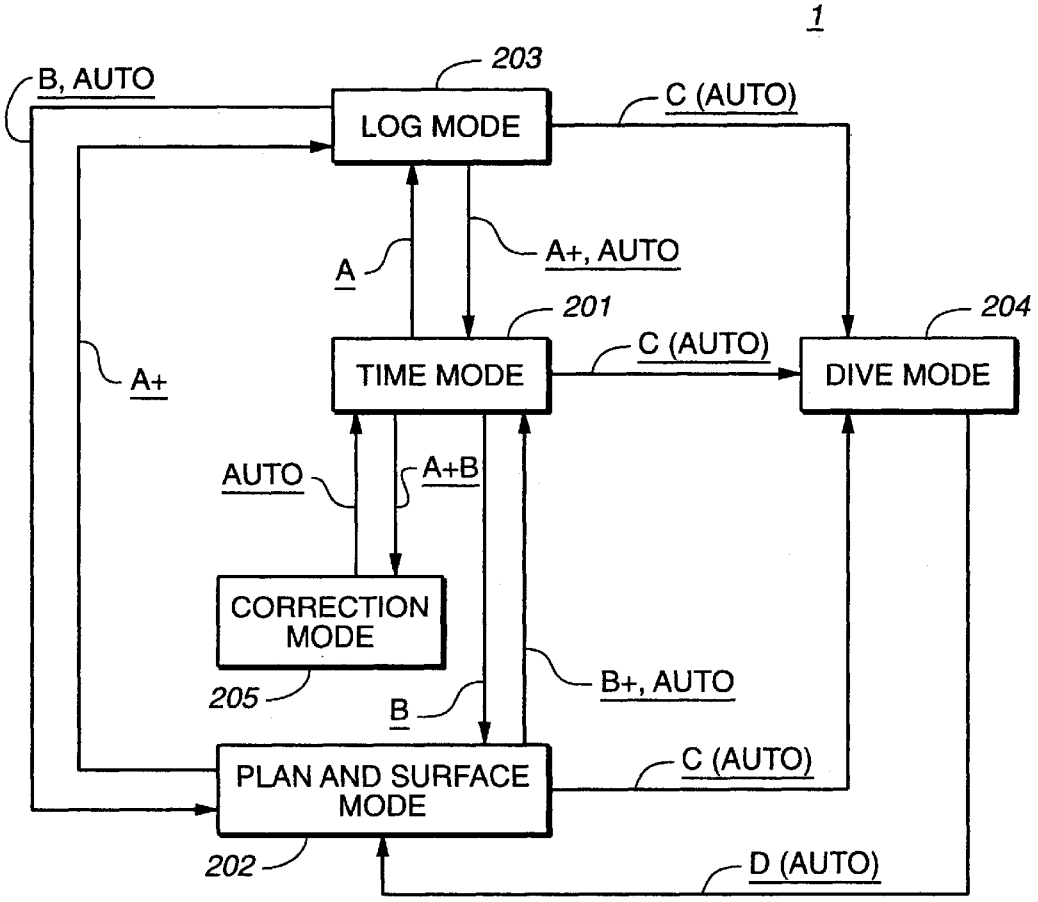
FIG. 1 is an explanatory diagram for explaining the change of a plurality of display modes in an embodiment of a divers' information display device in accordance with the present invention.
Figure 2:
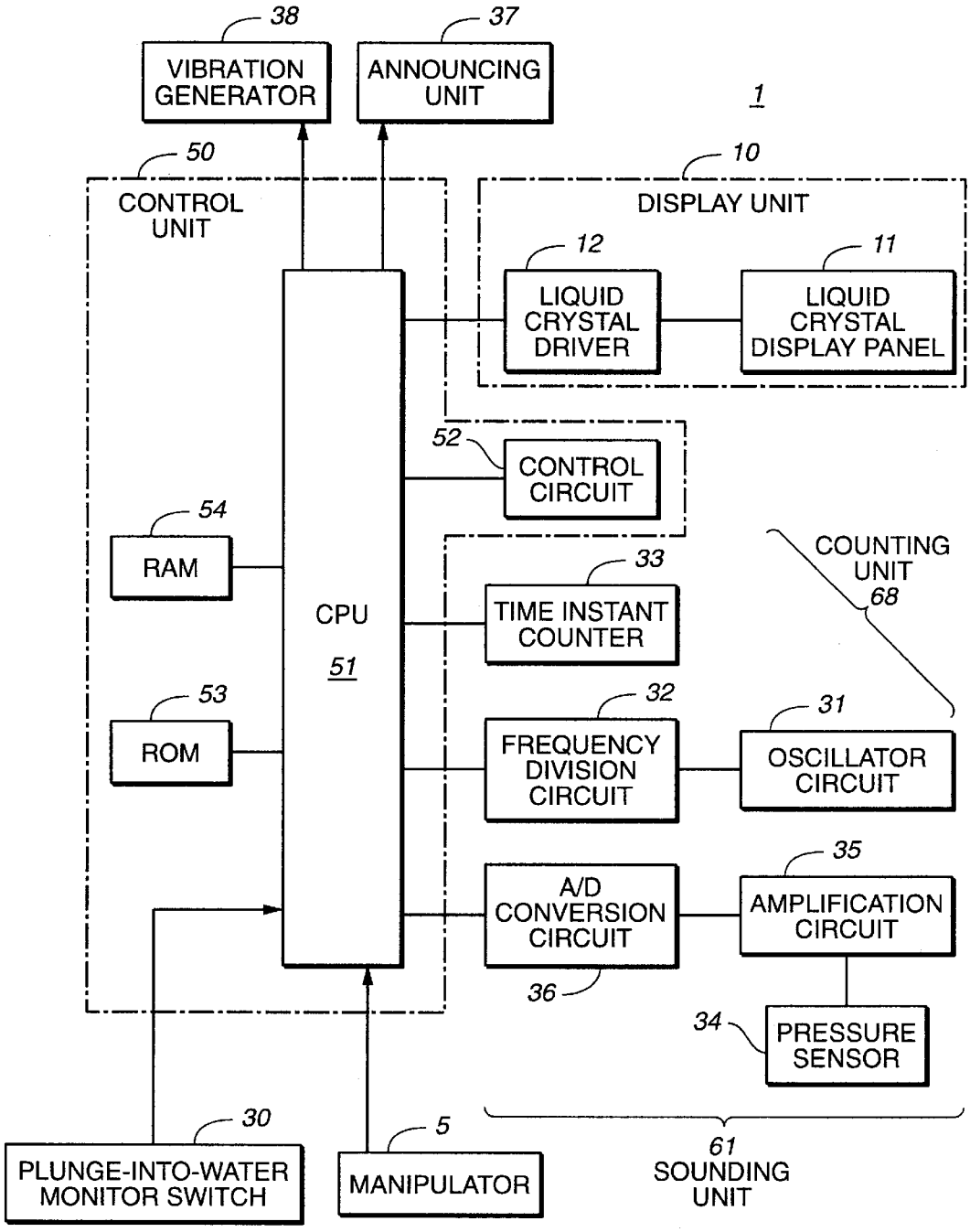
FIG. 2 is a block diagram showing the hardware configuration of a dive computer.
Figure 3:
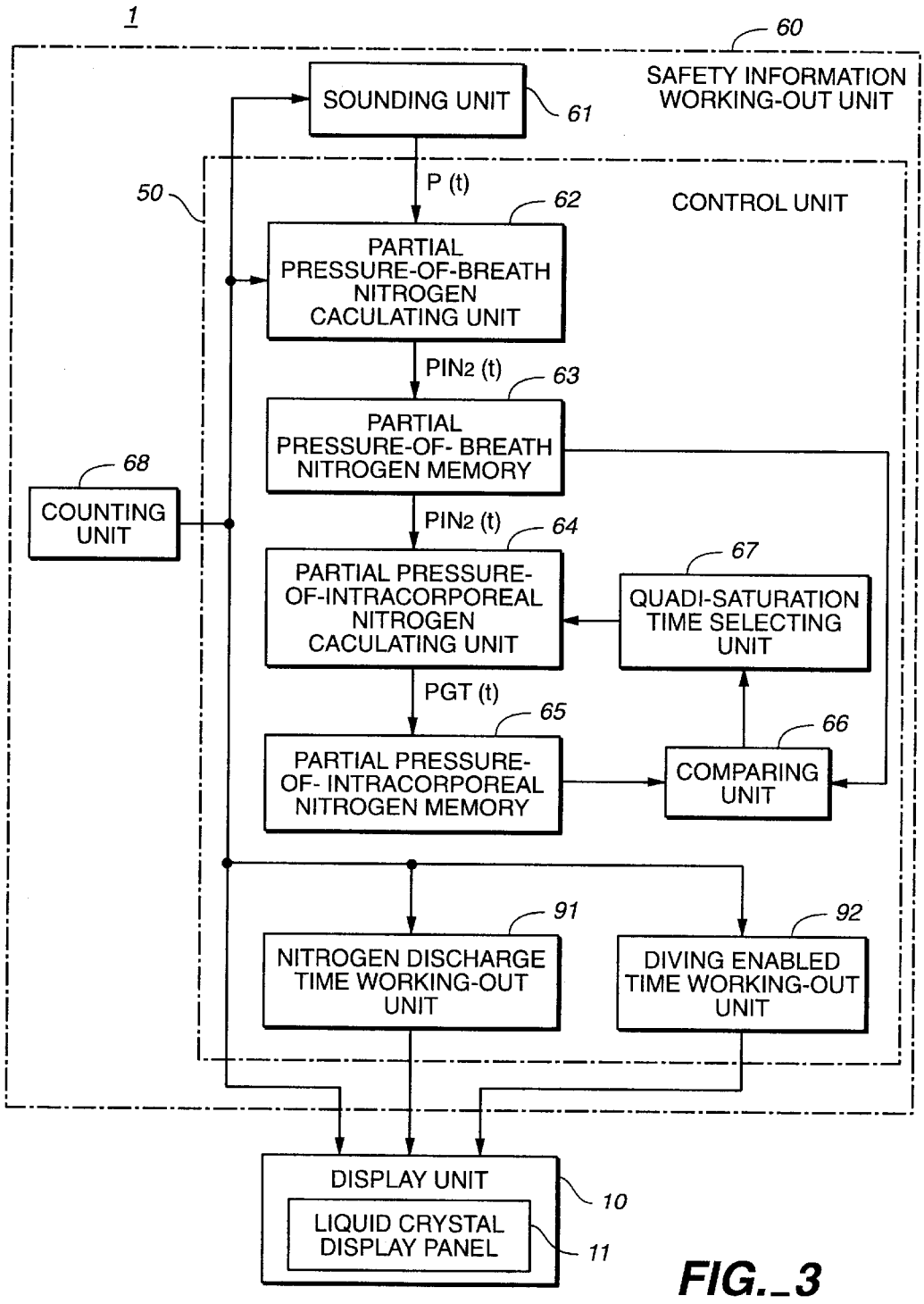
FIG. 3 is a functional block diagram showing basic facilities included in the dive computer.

Next, an embodiment of the present invention will be described with reference to the appended drawings. FIG. 1 is a conceptual diagram illustratively indicating the relationship of change among display modes in an embodiment of a divers' information display device in accordance with the present invention. This embodiment is formed as a divers' information display device capable of switching indications among display modes and switching the display modes as shown in FIG. 1. The divers' information display device is realized with the hardware incorporated in a wristwatch-like dive computer (divers' information processing apparatus). FIG. 2 is a block diagram schematically showing the internal configuration of the dive computer 1. FIG. 3 is a functional block diagram showing the major portion of a facility implementing unit realized with the internal configuration. Moreover, FIG. 4 schematically shows the appearance of the dive computer 1.

Overall Configuration

As shown in FIG. 2, the dive computer 1 has a display unit 10, and a control unit 50 formed as a microprocessor unit (MPU). The display unit 10 includes a liquid crystal display panel 11 and a liquid crystal driver 12. The control unit 50 includes a central processing unit (CPU) 51, a control circuit 52, and information memory such as a ROM 53 and RAM 54. The liquid crystal driver 12 is connected to the central processing unit 51 and to the control circuit 52. Moreover, a sounding unit 61 including a counting unit 68, a pressure sensor 34, an amplification circuit 35, and an analog-to-digital (A/D) conversion circuit 36, is connected to the central processing unit 51. The counting unit 68 includes a frequency division circuit 32 an oscillator circuit 31 and a time instant counter 33.

Figure 4:
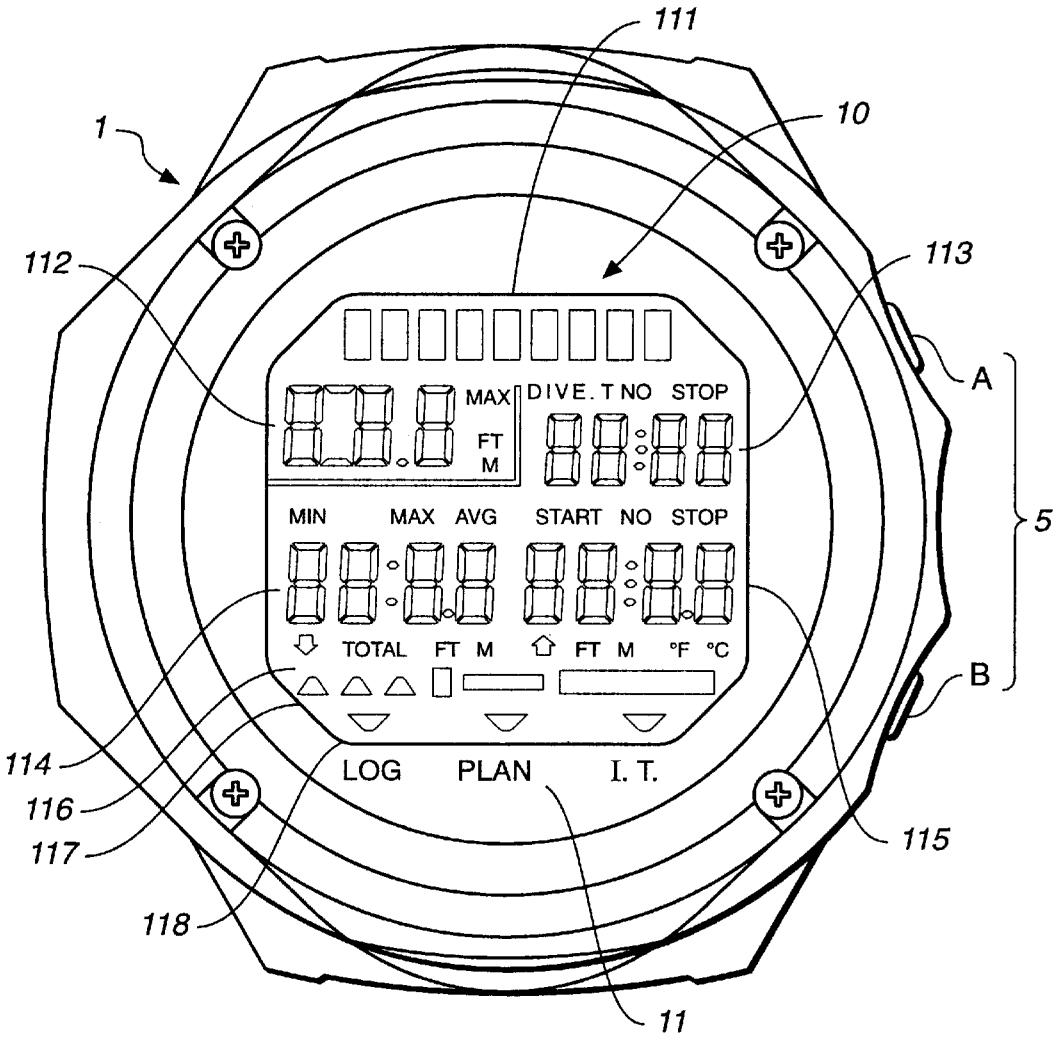
FIG. 4 is a schematic plan view showing the appearance of the body of the dive computer.

The central processing unit 51 is designed to receive a signal associated with a manipulation performed on a manipulator 5 including external manipulation members A and B shown in FIG. 4. When the external manipulation member A or B is pressed, a pulsating signal is sent to the central processing unit 51 and thus informs the central processing unit 51 of the fact that the external manipulation member A or B has been manipulated. The central processing unit 51 is designed to recognize not only the fact that the external manipulation member A or B has been pressed but also a time during which the external manipulation member A or B is held down and the number of times by which the external manipulation member A or B has been pressed.

Moreover, the central processing unit 51 is designed to receive a signal from a plunge-into-water monitor switch 30 having a moisture detector. The moisture detector includes a pair of electrodes bared on the surface of the body of the dive computer 1. The pair of electrodes conducts due to seawater, whereby moisture is sensed. When the moisture detector detects moisture, the plunge-into-water monitor switch 30 informs the central processing unit 51 of the fact that a wearer has plunged into water. However, even when the moisture detector detects moisture, the central processing unit 51 does not immediately judge that diving has been started. When the moisture detector detects moisture, the central processing unit 51 checks a pressure detected by the pressure sensor 34 as described later. Only when recognizing based on the pressure that a current depth of water is equal to or larger than a predetermined depth of water (for example, a depth of water of 1.5 m), the central processing unit 51 judges that diving has been started. When the current depth of water becomes smaller than the predetermined depth of water, the central processing unit 51 judges that diving has been terminated. A dive history memory (not shown) realized with the central processing unit 51, ROM 53, and RAM 54 stores data acquired during one diving period from the start of diving to the end thereof as log data. The data includes a maximum depth of water, an average depth of water, a diving time, and the partial pressure of intracorporeal nitrogen. Up to ten dive logs can be stored. After diving is terminated, if the current depth of water becomes larger than the predetermined depth of water (1.5 m) within a predetermined time (for example, 10 min), the previous diving is regarded as continuing. One log data set is therefore produced. However, the criterion for the start and end of diving is not limited to the aforesaid one, that is, the criterion of whether a diver has plunged into water or withdrawn therefrom. Various criteria are conceivable.

Furthermore, an announcing unit 37 and a vibration generator 38 produce an alarm according to an output signal of the central processing unit 51. The announcing unit 37 issues an alarm sound in various cases where an alarm is needed. The vibration generator 38 causes the dive computer 1 body to generate vibrations in various cases where an alarm is needed during diving. The vibrations inform a wearer of the alarm.

A clock signal generated by the oscillator circuit 31 has the frequency thereof divided into a predetermined frequency by the frequency division circuit 32. The clock signal is then sent to the central processing unit 51 and time instant counter 33. The time instant counter 33 receives the clock signal from the frequency division circuit 32 and counts clock pulses under the control of the control circuit 52. The time instant counter 33 then outputs time instant data to the central processing unit 51. The control circuit 52 controls the time instant counter 33 and liquid crystal driver 12 according to a command issued from the central processing unit 51.

A pressure sensitive unit of the pressure sensor 34 is connected to the outside of the computer body. A detection signal proportional to a detected external pressure is amplified by the amplification circuit 35. An analog signal output from the amplification circuit 35 is digitized by the A/D conversion circuit 36, and then output to the central processing unit 51.

A predefined program is stored in the ROM 53. Based on the program, the central processing unit 51 executes a predetermined calculation to be described later, and controls display modes in which data is displayed on the display unit 10. Final data of the date, diving time, and maximum depth of water concerning a past dive, which are obtained through detection or arithmetic operations, is stored in the RAM 54. Various intermediate data calculated by the central processing unit 51 is also temporarily stored in the RAM 54.

Appearance of the Display Unit

As shown in FIG. 4, the liquid crystal display panel 11 is placed in the display unit 10 located on the front side of the dive computer 1. A plurality of display areas are defined in the liquid crystal display panel 11. An amount of intracorporeal nitrogen (or the partial pressure of an intracorporeal nitrogen gas) calculated according to a procedure described later is graphically indicated in an upper display area 111.

In a display area 112 adjoining the left lower side of the display area 111, a day of the week is indicated in a time mode to be described later. A scheduled diving depth of water (a depth-of-water rank) is indicated in a plan and surface mode to be described later. A maximum depth of water retrieved from a displayed dive log (history) or the log number of the dive log is indicated in a log mode. A current depth of water is indicated in a dive mode.

In a display area 113 adjoining the right lower side of the display area 111, a date (month/day) is indicated in the time mode. A non-decompression diving enabled time (maximum diving time permitting ascending without decompression) associated with the depth-of-water rank indicated in the display area 112 is indicated in the plan and surface mode. Date retrieved from a dive log or a diving time is indicated in the log mode. A current diving time or a current time instant is indicated in the dive mode.

In a display area 114 adjoining and below the display area 112, an hour/min indication of a current time instant is displayed in the time mode. An intracorporeal nitrogen discharge completion time (time required for completely discharging accumulated intracorporeal nitrogen on the surface of the water) is indicated in the plan and surface mode. A diving start time instant or an average depth of water is indicated in the log mode. A maximum depth or a total ascending time (time required for rising to the surface of the water when decompression is needed) is indicated in the dive mode.

In a display area 115 adjoining and below the display area 113, a second indication of a current time instant is displayed in the time mode. A surface-of-water pause time (time during which a diver is floating on the surface of the water, that is, time during which intracorporeal nitrogen is discharged on the surface of the water) is indicated in the plan and surface mode. A maximum depth-of-water water temperature is indicated in the log mode. A non-decompression diving enabled time, a decompression pause depth of water (depth of water at which a diver pauses for decompression during ascending), or a decompression pause time (time during which a diver pauses on the surface of the water) is indicated in the dive mode.

In a narrow display area 116 adjoining and below the display areas 112 and 113, a mark indicating whether an amount of intracorporeal nitrogen is increasing (tends to be absorbed) or decreasing (tends to be discharged) is displayed. Moreover, a mark indicating an altitude (an altitude is expressed with a different number of marks such as mountain marks), a mark expressing a decompression diving alarm, a mark expressing an ascending speed alarm, and a mark indicating an amount of electrical energy remaining in a battery are displayed in a display area 117 below the display area 116. The mark expressing the decompression diving alarm indicates that decompression is needed. The mark expressing the ascending speed alarm alarms that the ascending speed should be decreased because it has exceeded a predefined speed during decompression. Furthermore, in a lowermost display area 118 below the display area 117, a mark expressing a currently designated display mode is displayed.

Procedure for calculating an amount of intracorporeal nitrogen

FIG. 3 is a functional block diagram showing an example of the configuration for calculating the partial pressure of an intracorporeal nitrogen gas in accordance with this embodiment. Various procedures are conceivable and adaptable in calculating the partial pressure of intracorporeal nitrogen. An example of the procedures will be described below.

As shown in FIG. 3, safety informstion working-out unit 60 includes and change "means" to unit the sounding means 61 composed of the pressure sensor 34, amplification circuit 35, and A/D conversion circuit 36 measures a hydraulic pressure P(t) in relation to time instants t in cooperation with the counting unit 68 composed of the oscillator circuit 31, frequency division circuit 32, and time instant counter 33. The sounding unit 61 then outputs the hydraulic pressure P(t). Thereafter, a partial pressure-of-breath nitrogen calculating unit 62 realized with the central processing unit 51, ROM 53, and RAM 54 calculates the partial pressure of nitrogen in breath $PIN_2(t)$ according to a formula (2) to which the hydraulic pressure P(t) is assigned. The calculated partial pressure of breath nitrogen $PIN_2(t)$ is stored in a partial pressure-of-breath nitrogen memory unit 73 realized with the RAM 54.

$$PIN_2(t)=0.79\times(P(t)-0.063)[\text{bar}] \quad (2)$$

A partial pressure-of-intracorporeal nitrogen calculating unit 64 realized with the central processing unit 51, ROM 53, and RAM 54 calculates the partial pressure of intracorporeal nitrogen PGT(t) in relation to intracorporeal tissues that are mutually different in an absorbing or discharging speed of nitrogen. Taking one tissue for instance, the partial pressure of intracorporeal nitrogen $PGT(t_E)$ to be absorbed or discharged during a time interval from a diving time instant $t=t_0$ to a time instant $t=t_E$ is calculated repeatedly according to a formula (3) below. The partial pressure of intracorporeal nitrogen at the time instant $t_0$, $PGT(t_0)$, a diving time $t_E$, and a quasi-saturation time $T_H$ are assigned to the formula (3). k in the formula (3) denotes an experimentally determined constant.

The partial pressure of intracorporeal nitrogen $PGT(t_E)$ is stored in a partial pressure-of-intracorporeal nitrogen memory unit 65 realized with the RAM 54.

$$PGT(t_E)=PGT(t_0)+\{PIN_2(t_0)-PGT(t_0)\times\{1-\exp[-k(t_E-t_0)/T_H]\} \quad (3)$$

A comparing unit 66 realized with the central processing unit 51, ROM 53, and RAM 54 compares $PIN_2(t)$ stored in the partial pressure-of-breath nitrogen memory unit 63 with PGT(t) stored in the partial pressure-of-intracorporeal nitrogen memory unit 65. Depending on the results of comparison, that is, depending on which of $PIN_2(t)$ and PGT(t) is larger, a quasi-saturation time selecting unit 67 realized with the central processing unit 51, ROM 53, and RAM 54 selects either of different quasi-saturation times $T_{H1}$ and $T_{H2}$ as a quasi-saturation time $T_H$ as indicated in formulas (4) and (5). This quasi-saturation time $T_H$ is used to solve the formula (3) next time.

$$PGT(t)>PIN_2(t)\rightarrow T_H=T_{H1} \quad (4)$$

$$PGT(t)<PIN_2(t)\rightarrow T_H=T_{H2} \quad (5)$$

In the case expressed as the formula (4), nitrogen is discharged from a diver's body. In the case expressed as the formula (5), nitrogen is absorbed into the diver's body. The quasi-saturation time to be assigned to the formula (3) differs between when nitrogen is discharged from the diver's body and when nitrogen is absorbed into the diver's body. It takes much more time for discharging nitrogen from the diver's body than it does for absorbing nitrogen into the diver's body. For this reason, $T_{H1}$ is generally larger than $T_{H2}$. Thus, an amount of intracorporeal nitrogen calculated in either of the cases expressed as the formula (4) and (5) can be simulated more faithfully.

The formula (3) is used to calculate the partial pressure of breath nitrogen $PIN_2(t)$ and the partial pressure of intracorporeal nitrogen PGT(t). Moreover, a time required until the partial pressure of intracorporeal nitrogen reaches an equilibrium value on the surface of the water can also be calculated using the formula (3). This calculation is achieved using the central processing unit 51, ROM 53, and RAM 54. This functional unit is shown as a nitrogen discharge time working-out unit 91 in FIG. 3. Likewise, a permissible value of the partial pressure of intracorporeal nitrogen (the value of a partial pressure that does not require decompression) may be determined in advance. In this case, the time required until the partial pressure of intracorporeal nitrogen accumulated at a predetermined depth of water (hydraulic pressure) reaches the permissible value (non-decompression diving enabled time) can be calculated. This calculation is achieved by a facility realized with the central processing unit 51, ROM 53, and RAM 54. This functional unit is shown as a diving enabled time working-out unit 92 in FIG. 3.

Display Mode

Finally, the major portion of the divers' information display device of this embodiment will be described below. The major portion is realized as a display mode control unit (not shown) for controlling display modes with the central processing unit 51, ROM 53, and RAM 54. This unit implements a time mode, a plan and surface mode, a log mode, a dive mode, and a correction mode in which the contents of display are displayed on the liquid crystal display panel 11 of the display unit 10 in predetermined ways. Moreover, the display mode control unit controls switching of display modes according to the contents of a manipulation performed on the manipulator 5 (external manipulation members A and B) or the contents of an event sensed by the plunge-into-water monitor switch 30 or pressure switch 34.

Time Mode

Figure 5:
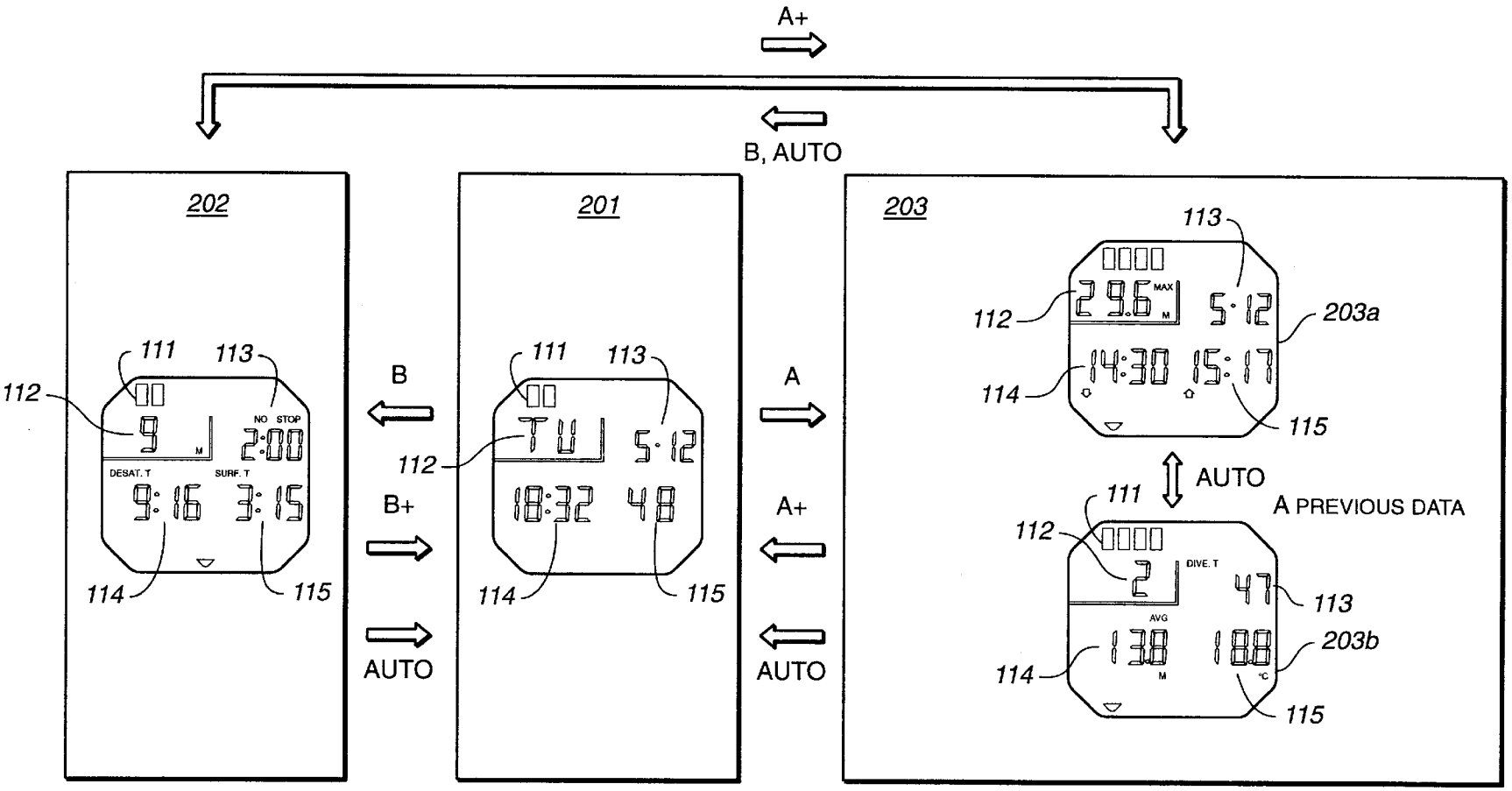
FIG. 5 is an explanatory diagram showing indications displayed in a time mode, a plan and surface mode, and a log mode, and change of the modes.

As shown in FIG. 5, a day of the week (display area 112), a date (display area 113), a current hour/min (display area 114), and a current second (display area 115) are indicated in a time mode 201. The capability of an ordinary wristwatch is achieved in the time mode 201. When intracorporeal nitrogen is accumulated, the amount or partial pressure of intracorporeal nitrogen is graphically indicated in the display area 111. As one of the display modes of the dive computer, the time mode 201 is a basic mode as long as a wearer is floating on the surface of the water. Unless any manipulation is performed, the time mode 201 is maintained irrespective of the amount or partial pressure of intracorporeal nitrogen. Moreover, data acquired by measuring an atmospheric pressure (performed at intervals of, for example, ten min) using a pressure sensor is used to indicate an altitude rank. At this time, the altitude rank is classified into ranges of 0 to 800 m, 800 to 1600 m, 1600 to 2400 m, 2400 to 6000 m, and 6000 m or more. The altitude ranges are distinguished from one another according to a different number of mountain-like marks or flickering of a mark. Moreover, an amount of electrical energy remaining in a battery is indicated.

Plan and Surface Mode

In a plan and surface mode 202, when intracorporeal nitrogen is not accumulated, a depth-of-water rank (display area 112) and a non-decompression diving enabled time (display area 113) associated with the depth-of-water rank are indicated. When intracorporeal nitrogen is accumulated, an amount or partial pressure of intracorporeal nitrogen (display area 111), an intracorporeal nitrogen discharge completion time (display area 114), and a surface-of-water pause time (display area 115) are indicated in addition to the above items. Incidentally, when intracorporeal nitrogen is not accumulated, time data such as a date and a time instant may be indicated in the display areas 114 and 115. The depth-of-water rank can be set to any of a plurality of values by a wearer. For example, a plurality of depth-of-water values ranging from 9 to 48 m can be set. For setting the depth-of-water rank, the external manipulation member B is pressed. The non-decompression diving enabled time represents a time during which diving can be achieved without decompression. The non-decompression diving enabled time is calculated based on the aforesaid principles using the set value of the depth-of-water rank and the partial pressure or amount of accumulated intracorporeal nitrogen. The intracorporeal nitrogen discharge completion time represents the time required until the partial pressure of intracorporeal nitrogen reaches an equilibrium value when a diver is floating on the surface of water or staying on the water. The intracorporeal nitrogen discharge completion time is calculated using the current partial pressure or amount of accumulated intracorporeal nitrogen. The surface-of-water pause time represents an elapsed time since the instant the depth of water (hydraulic pressure) becomes 1.5 m or less after diving.

Log mode

In a log mode 203, a past dive log is retrieved and displayed. Since the number of display areas is limited, two display screens 203*a* and 203*b* are switched alternately at intervals of a predetermined cycle (for example, at intervals of 4 to 5 sec). On the display screen 203*a*, a maximum depth of water (display area 112), a date (display area 113), a diving start time instant (display area 114), and a diving end time instant (display area 115) are displayed as data retrieved from the dive log. In contrast, the display screen 203*b* is used to indicate a log number, that is a series number assigned to dive log data recorded in that day among stored dive log data (display area 112), a diving time (display area 113), an average depth of water (display area 114), and a maximum depth-of-water water temperature (display area 115). Moreover, on either of the display screens, the partial pressure of intracorporeal nitrogen detected at the end of diving is graphically indicated. Besides, an altitude rank at which diving is performed and an alarm are indicated. When the external manipulation member A is pressed, old dive log data is retrieved in order.

Dive mode

Figure 6:
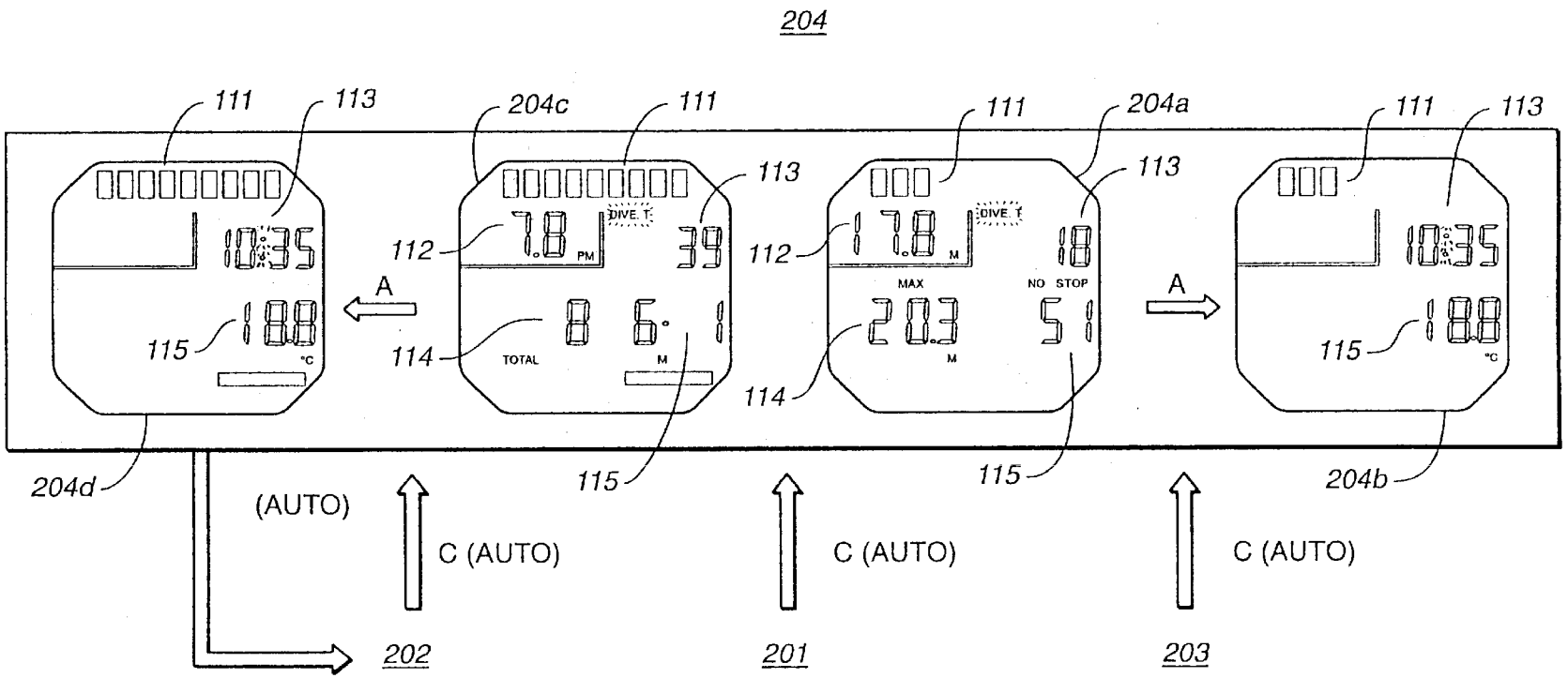
FIG. 6 is an explanatory diagram showing an indication to be displayed in a dive mode, and change of the modes.

A dive mode 204 is a way of displaying indications during diving. As shown in FIG. 6, four display screens 204*a*, 204*b*, 204*c*, and 204*d* are defined for the dive mode. The display screen 204*a* and display screen 204*b* are used when an amount of intracorporeal nitrogen is equal to or smaller than a permissible value. The display screen 204*a* is a basic screen for the dive mode 204 and used to indicate a current depth of water (display area 112), a diving time (display area 113), a maximum depth of water (display area 114), and a non-decompression diving enabled time (display area 115). While the external manipulation member A is held down, the display screen 204*b* is to activate instead of the display screen 204*a*. The display screen 204*b* is used to indicate a current time instant (display area 113) and a current water temperature (display area 115). In the dive mode, whichever of the display screens is validated, an amount of intracorporeal nitrogen is graphically indicated (display area 111).

When the amount of intracorporeal nitrogen exceeds a permissible value during diving, the graphical indication of the amount of intracorporeal nitrogen indicates that fact. Moreover, the display screen 204*a* is switched to the display screen 204*c*. The display screen 204*c* is used to indicate a current depth of water (display area 112), a diving time (display area 113), a total ascending time (display area 114), and a decompression pause depth of water and a decompression pause time (display area 115). The total ascending time represents the time required for rising from the current depth of water to the surface of the water at a speed of 8m/min while pausing for decompression. The decompression depth of water represents a depth of water at which a diver should pause for decompression, and is, for example, 15 m, 12 m, 9 m, 5 m, 6 m, or 3 m. The decompression depth of water is calculated according to a state of diving, and the largest one of calculated values is indicated. The decompression pause time represents the time during which ascending should be suspended at the depth of water at which a diver should pause for decompression. The decompression pause time is calculated using an amount of wearer's intracorporeal nitrogen during decompression. When the external manipulation member A is pressed, the display screen 204*c* is switched to the display screen 204*d*. The display screen 204*d* is, similarly to the display screen 204*b*, used to indicate a current time instant (display area 113) and a current water temperature (display area 115). The predetermined alarm indication is displayed in the same manner as that on the display screen 204*c*.

In the dive mode, a decompression diving alarm is indicated together with an alarm sound produced by the announcing unit 37 and/or alarm vibrations generated by the vibration generator 38. The decompression diving alarm indicates that decompression ascending is needed because diving has continued for a time interval exceeding the non-decompression diving enabled time. Moreover, if a diver ascends at a speed exceeding a preferable ascending speed that is calculated according to a state of diving, an ascending speed alarm is indicated together with the alarm sound produced by the announcing unit 37. Furthermore, if the current depth of water is smaller than the decompression pause depth of water, a decompression pause instruction violation alarm is indicated together with the alarm sound.

Correction mode

Figure 7:
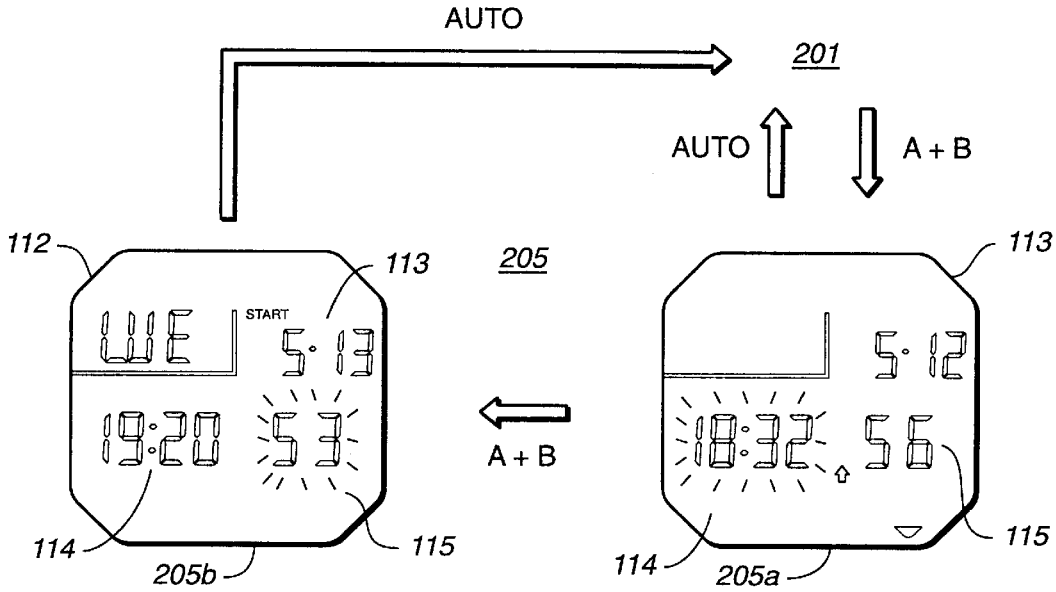
FIG. 7 is an explanatory diagram showing an indication displayed in a correction mode, and change of the modes.
Figure 8A:
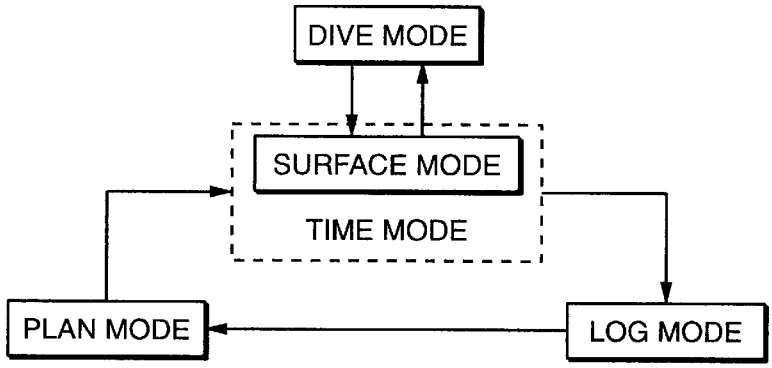
FIG. 8(*a*) and FIG. 8(*b*) show two examples of the change of the display modes in a conventional dive computer.
Figure 8B:
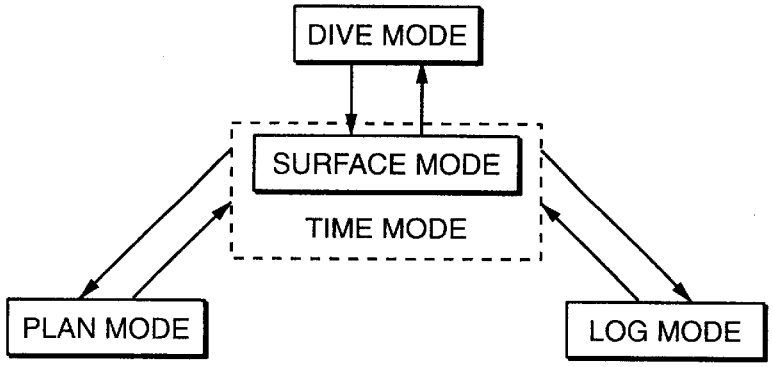

A correction mode 205 succeeds the time mode 201 in response to a manipulation to be described later. A display screen 205*a* activated after the time mode 201 is changed to the correction mode 205 (FIG. 7) is a display screen assigned to a time difference correction mode. A date, an hour/min current time, and a second current time are indicated on the display screen. On the display screen 205*a*, every time the external manipulation member A is pressed, increasing or decreasing the hour/min indication, that is, directions in which a time difference is corrected, are switched. When the external manipulation member B is pressed, a current time instant can be increased or decreased in units of a predetermined time (for example, one hour, 30 min, or 15 min). In whichever region in the world with a standard time zone a diver enjoys diving, the hour/min indication should normally be corrected in units of 30 min or 15 min. It is unnecessary to correct the second indication. Owing to the inclusion of the time difference mode, a correction error (for example, correction is made by less than 15 min or by seconds) will not take place but a time difference can be corrected readily.

On the display screen 205*a* assigned to the time difference correction mode, the external manipulation member B is pressed for 4 to 5 seconds with the external manipulation member A held down. The display screen 205*a* is then switched to the display screen 205*b*, whereby a time instant correction mode is activated. In the time instant correction mode, the same indications as those in the time mode are corrected in the same manner as ordinary correction of a time instant. Specifically, the indications to be corrected are changed successively with every press of the external manipulation member A. A selected indication flickers. In this state, when the external manipulation member B is pressed, it becomes possible to modify the selected indication.

Switching display modes

Next, switching of the display modes will be described below. FIG. 1 schematically indicates switching of the display modes. When the external manipulation member A shown in FIG. 4 is pressed (A), the time mode 201 is changed to the log mode 203. When the external manipulation member B is pressed (B), the time mode 201 is changed to the plan and surface mode 202. When the external manipulation member B is held down for 2 to 3 sec (B+) in the plan and surface mode 202, the time mode 201 is restored. When the external manipulation member A is held down for 2 to 3 sec (A+), the plan and surface mode 202 is changed to the log mode 203. Furthermore, when the external manipulation member A is held down for 2 to 3 sec (A+) in the log mode 203, the time mode 201 is restored. When the external manipulation member B is pressed (B), the log mode 203 is changed to the plan and surface mode 202. Incidentally, the manner of manipulating the external manipulation members A and B (a pressing time or the number of presses) may be defined properly in line with manipulations performed on the switches in the display modes. If a higher priority is given to change of the display modes than those given to manipulations performed in the display modes, all changes can be achieved merely by pressing an external manipulation member for a short time interval.

In this embodiment, the three display modes of the time mode 201, plan and surface mode 202, and log mode 203 can be changed directly to one another by manipulating the external manipulation member A or B. Moreover, each manipulation to be performed for change of display modes always involves either the external manipulation member A or B. Furthermore, for changing from two of the above three display modes other than the plan and surface mode 202 to the plan and surface mode 202, the external manipulation member B is always manipulated. For changing from two of the above three display modes other than the log mode 203 to the log mode 203, the external manipulation member A is always manipulated. The manner of manipulation can therefore be learned easily and memorized easily. This is advantageous.

After plunging into water is acknowledged by the plunge-into-water monitor switch 30, any of the time mode 201, plan and surface mode 202, and log mode 203 is automatically changed to the dive mode 204 (C(AUTO)). This is intended to prevent a diver from forgetting to change any of the modes to the dive mode. After a diver designates the dive mode 204, if the diver ascends, the dive mode 204 is automatically changed to the plan and surface mode 202 (D(AUTO)). When a diver ascends, the diver can plan a diving schedule immediately without the necessity of manipulating any external manipulation member.

The time mode 201, plan and surface mode 202, and log mode 203 are automatically changed to one another. Specifically, after a predetermined time (for example, 5 to 6 min) elapses in the plan and surface mode 202, if no signal is input from the manipulator 5 and no intracorporeal nitrogen is accumulated, the time mode 201 is automatically restored. If no signal is input for a predetermined time but intracorporeal nitrogen is accumulated, display modes are not changed. However, the indications of a depth-of-water rank and a non-decompression diving enabled time (equivalent to those in a conventional plan mode) are deleted. If no manipulation is performed during a predetermined time (if no manipulation is performed for planning diving, or anyhow, for determining a depth-of-water rank), indications equivalent to those in the plan mode are deleted because they are unnecessary. This is intended to minimize consumed power. However, indications concerning an amount of intracorporeal nitrogen are left intact.

Moreover, if no manipulation is performed as mentioned above in the log mode 203 and no signal is input from the manipulator 5 for a predetermined time, as long as no intracorporeal nitrogen is accumulated, the time mode 201 is automatically restored. If intracorporeal nitrogen is accumulated, the log mode 203 is automatically changed to the plan and surface mode 202.

Mode changes to be performed between the time mode 201 and correction mode 205 will be described below. If both the external manipulation members A and B are held down for 4 to 5 sec (A+B), the time mode 201 is changed to the correction mode 205 and the display screen 205*a* assigned to the time difference correction mode included in the correction mode 205 is activated. When either the display screen 205*a* assigned to the time difference correction mode or the display screen 205*b* assigned to the time instant correction mode is activated, after a predetermined time (5 to 6 min) elapses, the time mode 201 is automatically restored without the necessity of manipulating any switch. The aforesaid automatic changes occurring when various predetermined times elapse are indicated with AUTO in FIG. 1 and FIG. 5 to FIG. 7.

In this embodiment, a surface mode and a plan mode need not be defined as separate display modes, though they are defined in the related art. Moreover, the time mode need not be accompanied by the surface mode. Specifically, this embodiment is characterized by the plan and surface mode in which the indications displayed in the conventional plan mode and the surface mode are partly integrated. Owing to the plan and surface mode, when a diving wearer ascends, the wearer can check an amount of intracorporeal nitrogen directly related to a current amount of intracorporeal nitrogen, an intracorporeal nitrogen discharge completion time, and a surface-of-water pause time. Besides, the wearer can read a depth-of water rank needed to plan a diving schedule and an associated non-decompression diving enabled time. This is advantageous in that all the information required for diving can be acquired without the necessity of switching. This leads to the user friendly configuration encouraging divers to dive while wearing the divers' information display device.

In this embodiment, any of the three modes; the time mode 201, plan and surface mode 202, and log mode 203 can be changed directly to one another. This leads to a decreased number of manipulations compared with the number of manipulations needed in the related art. Moreover, maneuverability has improved. In the three display modes, when a predetermined time has elapsed, unless intracorporeal nitrogen is accumulated, the time mode 201 is automatically restored. If intracorporeal nitrogen is accumulated, two of the three display modes are automatically changed to the plan and surface mode 202. An optimal way of displaying indications can thus be attained depending on a situation without any manipulation. Furthermore, after the dive mode 204 is designated, if a diver ascends, the dive mode is automatically changed to the plan and surface mode. Even if a diver ascends in the course of diving, the diver need not switch display modes during diving.

In this embodiment, the correction mode includes a time difference correction mode in which a time difference is corrected. A time difference can therefore be corrected readily. Moreover, correction of a time difference in units of a required time (30 min or 15 min) is exclusively enabled. A time instant being incorrectly corrected in units of a second (for example, a second indication is incorrectly modified) will, therefore, not take place.

The aforesaid embodiment is concerned with a wristwatch-like dive computer. The present invention is not limited to this embodiment, but may be adapted to the whole or part (display unit alone) of an apparatus capable of being worn on any part of a diver's body other than the arm, such as, a portable information terminal. Moreover, the facilities employed in the embodiment are not all realized by a microprocessor. All or part of the facilities may be realized with the hardware configuration including a logic circuit.

INDUSTRIAL APPLICABILITY

As described so far, according to the present invention, a plan and surface mode in which a physical indication and a diving schedule indication are displayed is implemented. Therefore, when a diver ascends during diving, the diver can grasp his/her physical condition without the necessity of switching display modes and can plan a diving schedule according to the physical condition. Switching indications between the plan and surface mode and a dive mode is automatically carried out at the start or end of diving or with suspension of diving. This almost completely obviates the necessity of performing manipulations during diving.

What is claimed is:

1. A diver's information display device that displays a diving situation indication, which indicates a diving situation of a wearer of the display device, a physical indications, which indicates a physical condition change that is attributable to the wearer diving and is calculated based on the diving situation, and a diving schedule indication, which indicates information that assists the wearer in planning a preferable diving schedule according to the physical indication, the diver's information display device comprising:

a display means for displaying in a plan and surface mode, in which a physical indication and a diving schedule indication are displayed, and in a dive mode in which a diving situation indication is displayed;

a mode changing means for automatically changing said display means from said plan and surface mode to said dive mode when diving is started in said plan and surface mode; and wherein said mode changing means is further for automatically changing said display means from said dive mode to said plan and surface mode when diving is terminated or suspended.

2. A diver's information display device according to claim 1, wherein said display means is further for displaying a time mode in which a time instant indication is displayed; and, wherein said mode changing means is further for automatically changing said time mode to said dive mode when diving is started in said time mode.

3. A diver's information display device according to claim 1, further comprising a dive history memory means for storing a dive history of a wearer's past dives; wherein said display means is further for displaying a log mode in which said dive history is retrieved and displayed; and wherein said mode changing means is further for automatically changing said log mode to said dive mode when diving is started in said log mode.

4. A diver's information display device according to claim 3, further comprising first and second external manipulation members; and, wherein said time mode, plan and surface mode, and log mode each comprise one of three display modes that are changed one to another; and, said mode changing means is responsive to manipulation of said first external manipulation member for changing one of two display modes, other than a first display mode, to the first display mode; and said mode changing means is responsive to manipulation of said second external manipulation member for changing one two display modes, other than a second display mode, to the second display mode.

5. A diver's information display device that displays a time instant indication, a diving situation indication, which indicates a diving situation of a wearer of the display device, a physical indication, which indicates a physical condition change that is attributable to the wearer diving and is calculated based on the diving situation, and a diving schedule indication, which indicates information that assists the wearer in planning a preferable diving schedule according to the physical indication, the diver's information display device comprising:

a dive history memory means for storing a dive history of a wearer's past dives;

first and second external manipulation members;

a display means for displaying in a time mode, in which a time instant indication is displayed, in a plan and surface mode, in which a physical indication and a diving schedule indication are displayed, a dive mode, in which a diving situation indication is displayed, and a log mode, in which said dive history is retrieved and displayed;

wherein said time mode, plan and surface mode, and log mode each comprise one of three display modes that are changed one to another; and, a mode changing means that is responsive to manipulation of said first external manipulation member for changing one of two display modes, other than a first display mode, to the first display mode; and said mode changing means is responsive to manipulation of said second external manipulation member for changing one two display modes, other than a second display mode, to the second display mode.

6. A divers' information display device according to claim 5, wherein said mode changing means is responsive to manipulation of said first external manipulation member for changing said time mode to said plan and surface mode, and thereafter responsive to manipulation of said first external manipulation member for restoring said time mode from said plan and surface mode; and said mode changing means is responsive to manipulation of said second external manipulation member for changing said time mode to said log mode, and thereafter responsive to manipulation of said second external manipulation member for restoring said time mode from said log mode.

7. A diver's information display device according to claim 6, wherein said mode changing means is responsive to manipulation of said second external manipulation member for changing said plan and surface mode to said log mode, and thereafter is responsive to manipulation of said first external manipulation member for restoring said plan and surface mode from said log mode.

8. A diver's information display device according to claim 5, wherein said mode changing means is responsive to manipulation of said first external manipulation member for changing said time mode to said plan and surface mode, and thereafter is responsive to manipulation of said second external manipulation member for changing from said plan and surface mode to said log mode; and wherein said mode changing means is responsive to manipulation of said second external manipulation member for changing said time mode to said log mode, and thereafter is responsive to manipulation of said first external manipulation member for changing from said log mode to said plan and surface mode.

9. A method of controlling a diver's information display device that displays a diving situation indication, which indicates a diving situation of a wearer of the display device, a physical indication, which indicates a physical condition change that is attributable to the wearer diving and is calculated based on the diving situation, and a diving schedule indication, which indicates information that assists the wearer in planning a preferable diving schedule according to the physical indication, the method comprising:

displaying a physical indication and a diving schedule indication in a plan and surface mode, and displaying a diving situation indication in a dive mode;

automatically changing from displaying in said plan and surface mode to displaying in said dive mode when diving is started in said plan and surface mode; and automatically changing from displaying in said dive mode to displaying in said plan and surface mode when diving is terminated or suspended.

10. A method of controlling a diver's information display device according to claim 9 further comprising displaying a time instant indication in a time mode; and automatically changing from displaying in said time mode to displaying in said dive mode when diving is started.

11. A method of controlling a diver's information display device according to claim 9, further comprising storing a dive history of a wearer's past dives; and retrieving and displaying said dive history in a log mode; and automatically changing from displaying in said log mode to displaying in said dive mode when diving is started in said log mode.

12. A method of controlling a diver's information display device according to claim 11, wherein said time mode, plan and surface mode, and log mode each comprise one of three display modes that are changed one to another; and, manipulating a first external manipulation member to change from one of two display modes, other than a first display mode, to the first display mode; and, manipulating a second external manipulation member to change from one of two display modes, other than a second display mode, to the second display mode.

13. A method of controlling a diver's information display device that displays a time instant indication, a diving situation indication, which indicates a diving situation of a wearer of the display device, a physical indication, which indicates a physical condition change that is attributable to the wearer diving and is calculated based on the diving situation, and a diving schedule indication, which indicates information that assists the wearer in planning a preferable diving schedule according to the physical indication, the method comprising:

storing a dive history of a wearer's past dives;

displaying a time instant indication in a time mode, displaying a physical indication and a diving schedule indication in a plan and surface mode, displaying a diving situation indication in a dive mode, and retrieving and displaying said dive history in a log mode;

wherein said time mode, plan and surface mode, and log mode each comprise one of three display modes that are changed one to another; and, manipulating a said first external manipulation member to change one of two display modes, other than a first display mode, to the first display mode; and, manipulating a second external manipulation member to change one two display modes, other than a second display mode, to the second display mode.

14. A method of controlling a divers' information display device according to claim 13, comprising manipulating said first external manipulation member to change from said time mode to said plan and surface mode, and thereafter manipulating said first external manipulation member to restore said time mode from said plan and surface mode; and, manipulating said second external manipulation member to change said time mode to said log mode, and thereafter manipulating said second external manipulation member to restore said time mode from said log mode.

15. A method of controlling a diver's information display device according to claim 14, comprising manipulating said second external manipulation member to change from said plan and surface mode to said log mode, and thereafter manipulating said first external manipulation member to restore said plan and surface mode from said log mode.

16. A method of controlling a diver's information display device according to claim 13, comprising manipulating said first external manipulation member to change from said time mode to said plan and surface mode, and thereafter manipulating said second external manipulation member to change from said plan and surface mode to said log mode; and, manipulating said second external manipulation member to change from said time mode to said log mode, and thereafter manipulating said first external manipulation member to change from said log mode to said plan and surface mode.

17. A diver's information display device that displays a diving situation indication, which indicates a diving situation of a wearer of the display device, a physical indication, which indicates a physical condition change that is attributable to the wearer diving and is calculated based on the diving situation, and a diving schedule indication, which indicates information that assists the wearer in planning a preferable diving schedule according to the physical indication, the diver's information display device comprising:

a display that displays in a plan and surface mode, in which a physical indication and a diving schedule indication are displayed, and in a dive mode in which a diving situation indication is displayed;

a control unit that automatically changes said display from said plan and surface mode to said dive mode when diving is started in said plan and surface mode; and wherein said control unit further automatically changes said display from said dive mode to said plan and surface mode when diving is terminated or suspended.

18. A diver's information display device according to claim 17, wherein said display further displays a time mode in which a time instant indication is displayed; and, wherein said control unit further automatically changes said time mode to said dive mode when diving is started in said time mode.

19. A diver's information display device according to claim 17, further comprising a dive history memory that stores a dive history of a wearer's past dives; wherein said display further displays a log mode in which said dive history is retrieved and displayed; and wherein said control unit further automatically changes said log mode to said dive mode when diving is started in said log mode.

20. A diver's information display device according to claim 19, further comprising first and second external manipulation members; and, wherein said time mode, plan and surface mode, and log mode each comprise one of three display modes that are changed one to another; and, said control unit is responsive to manipulation of said first external manipulation member for changing one of two display modes, other than a first display mode, to the first display mode; and said control unit is responsive to manipulation of said second external manipulation member for changing one two display modes, other than a second display mode, to the second display mode.

21. A diver's information display device that displays a time instant indication, a diving situation indication, which indicates a diving situation of a wearer of the display device, a physical indication, which indicates a physical condition change that is attributable to the wearer diving and is calculated based on the diving situation, and a diving schedule indication, which indicates information that assists the wearer in planning a preferable diving schedule according to the physical indication, the diver's information display device comprising:

a dive history memory that stores a dive history of a wearer's past dives;

first and second external manipulation members;

a display that displays in a time mode, in which a time instant indication is displayed, in a plan and surface mode, in which a physical indication and a diving schedule indication are displayed, a dive mode, in which a diving situation indication is displayed, and a log mode, in which said dive history is retrieved and displayed;

wherein said time mode, plan and surface mode, and log mode each comprise one of three display modes that are changed one to another; and, a control unit that is responsive to manipulation of said first external manipulation member for changing one of two display modes, other than a first display mode, to the first display mode; and said control unit is responsive to manipulation of said second external manipulation member for changing one two display modes, other than a second display mode, to the second display mode.

* * * * *

UNITED STATES PATENT AND TRADEMARK OFFICE

CERTIFICATE OF CORRECTION

PATENT NO. : 6,618,059 B1
DATED : September 9, 2003
INVENTOR(S) : Naoshi Furuta

It is certified that error appears in the above-identified patent and that said Letters Patent is hereby corrected as shown below:

Title page,
Item [22], change "PCT Filed: June 10, 1999" to -- PCT Filed: June 18, 1999 --.

Signed and Sealed this

Twenty-seventh Day of January, 2004

JON W. DUDAS
*Acting Director of the United States Patent and Trademark Office*